US009431757B2

(12) United States Patent
Liu

(10) Patent No.: US 9,431,757 B2
(45) Date of Patent: Aug. 30, 2016

(54) CONNECTION SOCKET FOR OVEN TEMPERATURE SENSOR

(71) Applicant: Shutie Liu, Guangdong (CN)

(72) Inventor: Shutie Liu, Guangdong (CN)

( * ) Notice: Subject to any disclaimer, the term of this patent is extended or adjusted under 35 U.S.C. 154(b) by 0 days.

(21) Appl. No.: 14/731,720

(22) Filed: Jun. 5, 2015

(65) Prior Publication Data

US 2016/0049748 A1 Feb. 18, 2016

(30) Foreign Application Priority Data

Aug. 12, 2014 (CN) ..... 2014 2 0451858

(51) Int. Cl.
*H01R 24/00* (2011.01)
*H01R 13/533* (2006.01)

(52) U.S. Cl.
CPC ..... *H01R 13/533* (2013.01)

(58) Field of Classification Search
CPC .... H01R 24/58; H01R 24/60; H01R 13/533; F24C 7/081
USPC ..... 439/668, 669; 73/23.25
See application file for complete search history.

(56) References Cited

U.S. PATENT DOCUMENTS 6,615,641 B2 * 9/2003 Kojima ..... G01N 27/4078 60/276
7,775,820 B2 * 8/2010 McCauley ..... G01N 27/407 439/260
2009/0255825 A1 * 10/2009 Zitzmann ..... G01K 7/16 205/216

* cited by examiner

*Primary Examiner* — Hae Moon Hyeon
(74) *Attorney, Agent, or Firm* — WPAT, P.C., Intellectual Property Attorneys; Anthony King

(57) ABSTRACT

A connection socket for oven temperature sensor, comprising: a shell with one end being sleeved and fixed on a plug guide hole seat, and the other end of the shell being internally disposed and fixedly provided with an inner ceramic plate and an outer ceramic plate; and a long elastic contact clip and a short elastic contact clip being respectively connected with the long lead and the short lead, both the long elastic contact clip and the short elastic contact clip being provided with a lug boss, wherein the lug bosses are clamped by the inner ceramic plate and the outer ceramic plate.

5 Claims, 2 Drawing Sheets

CONNECTION SOCKET FOR OVEN TEMPERATURE SENSOR

TECHNICAL FIELD

The present invention relates to the field of sensor connectors, and more particularly, to a connection socket for oven temperature sensor.

BACKGROUND

An oven is a household appliance for baking food in closed space, in which a temperature sensor is usually disposed to detect working temperature change information in the oven. The present temperature sensor employed in ovens usually needs to be connected with a socket via a plug for use; moreover, a temperature signal detected is transformed into an electric signal via the temperature sensor, and then the electric signal is transmitted to a control unit of the oven to realize temperature control through a connector of the plug and the socket. The present socket is complicated in structure and has instable electric connection with the plug, so that the temperature sensor works unstably. Moreover, the socket is not applicable to normal working above a high temperature of 400° C.

SUMMARY

The object of the present invention is to provide a connection socket for oven temperature sensor, which can be connected to a temperature sensor plug, has simple structure, and is stable during electrical connection.

According to an aspect of the present invention, there is provided a connection socket for oven temperature sensor, including a plug guide hole seat, a shell, an inner ceramic plate, an outer ceramic plate, a long lead, a short lead, a long elastic contact clip and a short elastic contact clip, wherein one end of the shell is sleeved and fixed on the plug guide hole seat, and the other end is internally disposed and fixedly provided with the inner ceramic plate and the outer ceramic plate; both the long elastic contact clip and the short elastic contact clip are provided with a lug boss, and the lug bosses are clamped by the inner ceramic plate and the outer ceramic plate.

Since the lug bosses between the long elastic contact clip and the short elastic contact clip are clamped by the inner ceramic plate and the outer ceramic plate, which ensures the firmness thereof, the stability of being electrically connected with the temperature sensor plug is thus improved.

In some implementations, one ends of the long elastic contact clip and the short elastic contact clip are both provided with a conductive snap ring disposed outside the shell, the other ends are both provided with an elastic contact clip disposed in the shell, and the middles are both provided with the lug boss. The long lead and the short lead are respectively inserted into two thread holes of the outer ceramic plate, and are correspondingly connected with the conductive snap rings. In this way, the long elastic contact clip and the short elastic contact clip are respectively connected with the long lead and the short lead using the conductive snap rings to ensure the electric connectivity of joints, and respectively chuck a contact pin of the plug using the elastic contact clips so as to ensure excellent contact.

In some implementations, the plug guide hole seat is provided with a guide hole. The outer wall of one end of the guide hole is provided with an external thread, and the outer wall of the other end is provided with a spacing stand. One end of the shell is sleeved and fixed on the other end of the guide hole, and is spaced in the spacing stand. In this way, the external thread at one end of the guide hole is employed for being connected with a thread of the plug, and the other end of the guide hole is employed for being sleeved and fixed with the shell, thus ensuring the connection reliability between the plug and the socket.

In some implementations, the shell compacts and fixes the inner ceramic plate and the outer ceramic plate through contraction calibers. In this way, the shell fixes the inner ceramic plate and the outer ceramic plate using an extrusion force at the position of the contraction caliber, which is simple in structure and is convenient to process.

In some implementations, the other end of the shell is sleeved with a cap, wherein the long lead and the short lead respectively traverse through the cap. In this way, the configuration of the cap plays a damp-proof role, prevent moisture or steam in the oven and external moisture or steam from inrushing to affect the insulating properties of the inner ceramic plate and the outer ceramic plate.

The present invention has simple structure and good insulativity, and has stable electric connection when being electrically connected with the temperature sensor plug, so that the temperature sensor works stably.

DETAILED DESCRIPTION

The present invention will be further described in details hereinafter with reference to the drawings.

Figure 1:
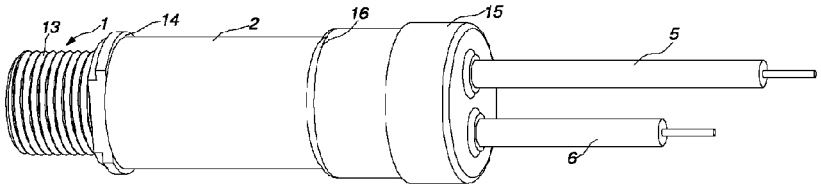
FIG. 1 is a stereoscopic schematic view of a socket according to an exemplary embodiment of the present invention.

FIG. 1 schematically displays a socket according to an exemplary embodiment of the present invention.

Figure 2:
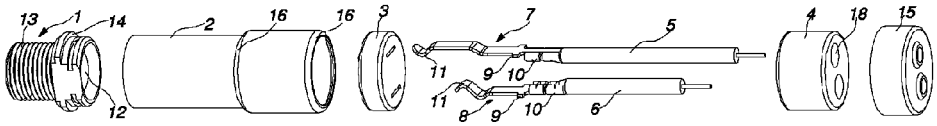
FIG. 2 is a explosion schematic view of the socket as shown in FIG. 1.
Figure 3:
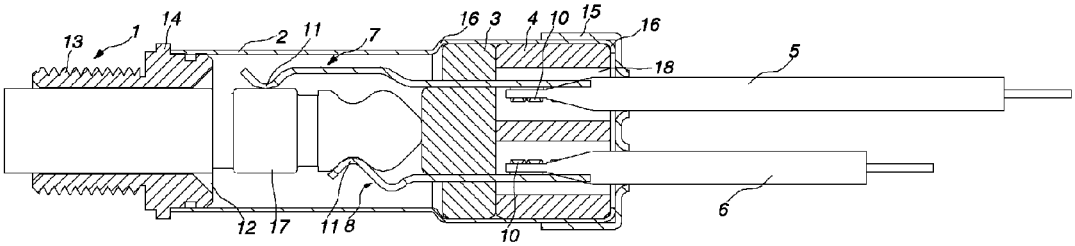
FIG. 3 is a cross section schematic view (including a contact pin of a plug connected) of the socket as shown in FIG. 1.

As shown in FIGS. 1, 2 and 3, the socket includes a plug guide hole seat 1, a shell 2, an inner ceramic plate 3, an outer ceramic plate 4, a long lead 5, a short lead 6, a long elastic contact clip 7 and a short elastic contact clip 8.

The plug guide hole seat 1 is made of stainless steel, wherein a body thereof is a guide hole 12. The outer wall of the left end of the guide hole 12 is provided with an external thread 13 via rolling. The root of the tail end of the external thread 13 is provided with a spacing stand 14. The outer wall of the right end of the guide hole 12 is sleeved with the left end of the shell 2, and is fixed via riveting or welding, and preferably via riveting. The spacing stand 14 plays a role of positioning when riveting the shell 2 with the guide hole 12. Moreover, the guide hole 12 and the shell 2 are through.

The right end of the shell 2 is internally provided with the inner ceramic plate 3 and the outer ceramic plate 4. The inner ceramic plate 3 and the outer ceramic plate 4 are made of high-temperature endurable insulating materials. The shell 2 positions the inner ceramic plate 3 and the outer ceramic plate 4 through two contraction calibers 16, and then compact and fix the inner ceramic plate and the outer ceramic plate by applying an extrusion force on the position of the contraction caliber 16.

Figure 4:
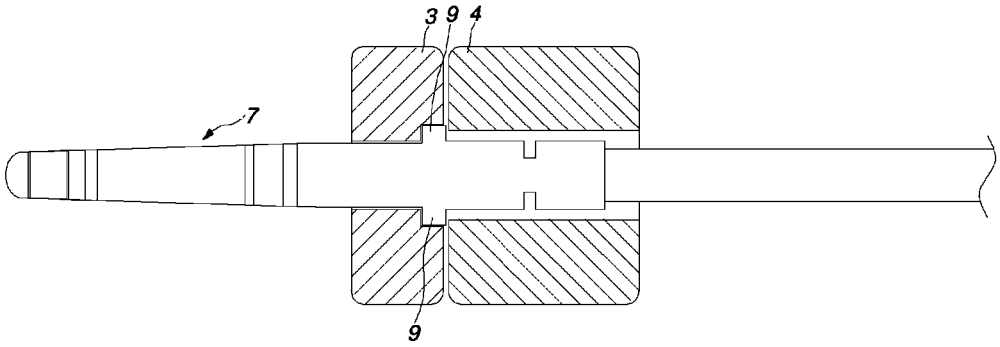
FIG. 4 is an installation schematic view of a long elastic contact clip, an inner ceramic plate and an outer ceramic plate of the socket as shown in FIG. 1.
Figure 5:
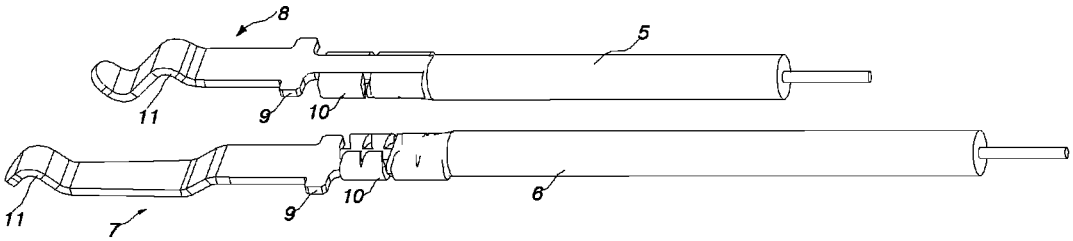
FIG. 5 is a stereoscopic schematic view of the long elastic contact clip and a short elastic contact clip of the socket as shown in FIG. 1.

As shown in FIGS. 3, 4 and 5, bodies of the long elastic contact clip 7 and the short elastic contact clip 8 are made of elastic sheetmetal. The one end of the long elastic contact clip and the short elastic contact clip are both conductive snap rings 10 disposed outside the shell 2, the other end are both elastic contact clips 11 disposed in the shell 2, and the middles are both provided with the lug boss 9. The long elastic contact clip 7 and the short elastic contact clip 8 respectively traverse the inner ceramic plate 3 and the outer ceramic plate 4, so that the insulativity of the long elastic contact clip and the short elastic contact clip is ensured by the ceramic materials. The lug bosses 9 are disposed between the long elastic contact clip 7 and the short elastic contact clip 8, and the lug bosses 9 between the long elastic contact clip 7 and the short elastic contact clip 8 are clamped by the inner ceramic plate 3 and the outer ceramic plate 4, which ensures the firmness of the long elastic contact clip 7 and the short elastic contact clip; therefore, the stability of the foregoing socket electrically connected with the temperature sensor plug is improved. The long lead 5 and the short lead 6 are corresponding riveted with the conductive snap rings 10, and are inserted into the two thread holes 18 of the outer ceramic plate 4, so as to ensure the electric connection via the conductive snap rings 10. The long lead 5 and the short lead 6 are made of high-temperature endurable insulating leads. Both the long elastic contact clip 7 and the short elastic contact clip 8 are respectively connected with the long lead 5 and the short lead 6 using the conductive snap rings 10 to ensure the electric connectivity of joints, and respectively chuck a contact pin 17 of the plug using the elastic contact clips 11 so as to ensure excellent contact.

As shown in FIGS. 1, 2 and 3, the right end of the shell 2 is sleeved with a cap 15, and is fixed via riveting or welding, and preferably via riveting. The long lead 5 and the short lead 6 respectively traverse from the cap 15. The configuration of the cap plays a damp-proof role, prevent moisture or steam in the oven and external moisture or steam from inrushing to affect the insulating properties of the inner ceramic plate 3 and the outer ceramic plate 4.

As shown in FIG. 3, when the socket is used, the temperature sensor plug is inserted from the guide hole 12 through the contact pin 17, and traversed out of the guide hole 12. The header of the contact pin 17 bears against the inner ceramic plate 3 inside the shell 2. The external side of the contact pin 17 is respectively contacted with the inside walls of the elastic contact clips 11 of the long elastic contact clip 7 and the short elastic contact clip 8, so as to ensure the electric connection. The external extension ends of the long lead 5 and the short lead 6 are connected with an external circuit.

The above only describes some implementations of the present invention. Those having ordinary skills in the art of the invention may also make many modifications and improvements without departing from the conceive of the invention which shall all fall within the protection scope of the invention.

What is claimed is:

1. A connection socket for oven temperature sensor, comprising: a plug guide hole seat (1), a shell (2), an inner ceramic plate (3), an outer ceramic plate (4), a long lead (5), a short lead (6), a long elastic contact clip (7) and a short elastic contact clip (8), wherein one end of the shell (2) is sleeved and fixed on the plug guide hole seat (1), and the other end is internally disposed and fixedly provided with the inner ceramic plate (3) and the outer ceramic plate (4); the long elastic contact clip (7) and the short elastic contact clip (8) respectively traverse the inner ceramic plate (3) and the outer ceramic plate (4), and are respectively connected with the long lead (5) and the short lead (6); both the long elastic contact clip (7) and the short elastic contact clip (8) are provided with a lug boss (9), and the lug bosses (9) are clamped by the inner ceramic plate (3) and the outer ceramic plate (4).

2. The connection socket for oven temperature sensor according to claim 1, characterized in that, one ends of the long elastic contact clip (7) and the short elastic contact clip (8) are both provided with a conductive snap ring (10), the other ends are both provided with an elastic contact clip (11) disposed in the shell (2), and the middles are both provided with the lug boss (9), the long lead (5) and the short lead (6) are respectively inserted into two thread holes (18) of the outer ceramic plate (4), and are correspondingly connected with the conductive snap rings (10).

3. The connection socket for oven temperature sensor according to claim 1, characterized in that, the plug guide hole seat (1) is provided with a guide hole (12), the outer wall of one ends of the guide hole (12) is provided with an external thread (13), and the outer wall of the other ends is provided with a spacing stand (14), one end of the shell (2) is sleeved and fixed on the other end of the guide hole (12), and is spaced in the spacing stand (14).

4. The connection socket for oven temperature sensor according to claim 1, characterized in that, the shell (2) clamps and fixes the inner ceramic plate (3) and the outer ceramic plate (4) through contraction calibers (16).

5. The connection socket for oven temperature sensor according to claim 1, characterized in that, the other end of the shell (2) is sleeved with a cap (15), and the long lead (5) and the short lead (6) respectively traverse through the cap (15).

* * * * *